US008148889B1

(12) United States Patent
DiSanto et al.

(10) Patent No.: US 8,148,889 B1
(45) Date of Patent: Apr. 3, 2012

(54) LOW VOLTAGE PHOSPHOR WITH FILM ELECTRON EMITTERS DISPLAY DEVICE

(75) Inventors: Frank J. DiSanto, Manhasset, NY (US); Denis A. Krusos, Llyod Harbor, NY (US)

(73) Assignee: CopyTele, Inc., Melville, NY (US)

( * ) Notice: Subject to any disclaimer, the term of this patent is extended or adjusted under 35 U.S.C. 154(b) by 0 days.

(21) Appl. No.: 12/798,800

(22) Filed: Apr. 12, 2010

Related U.S. Application Data

(63) Continuation of application No. 11/417,631, filed on May 4, 2006, now Pat. No. 7,728,506, which is a continuation-in-part of application No. 10/974,311, filed on Oct. 27, 2004, now Pat. No. 7,327,080, which is a continuation-in-part of application No. 10/782,580, filed on Feb. 19, 2004, now Pat. No. 7,274,136, which is a continuation-in-part of application No. 10/763,030, filed on Jan. 22, 2004, now abandoned, which is a continuation-in-part of application No. 10/102,472, filed on Mar. 20, 2002, now Pat. No. 7,129,626.

(60) Provisional application No. 60/698,047, filed on Jul. 11, 2005.

(51) Int. Cl.
*H01J 1/62* (2006.01)

(52) U.S. Cl. ..... 313/497; 313/495

(58) Field of Classification Search ..... 313/309–311, 313/495–497
See application file for complete search history.

(56) References Cited

U.S. PATENT DOCUMENTS

| | | | | |
|---|---|---|---|---|
| 3,755,704 | A | 8/1973 | Spindt | |
| 5,177,406 | A | 1/1993 | Troxell | |
| 5,214,347 | A | 5/1993 | Gray | |
| 5,345,141 | A | 9/1994 | Moyer | |
| 5,541,478 | A | 7/1996 | Troxell | |
| 5,736,814 | A | 4/1998 | Kinoshita | |
| 5,955,850 | A * | 9/1999 | Yamaguchi et al. | 313/495 |
| 6,023,126 | A | 2/2000 | Karpov | |
| 6,153,986 | A | 11/2000 | Dunphy | |
| 6,590,320 | B1 | 7/2003 | Abanshin | |
| 6,614,149 | B2 | 9/2003 | Kastalsky | |
| 6,674,242 | B2 | 1/2004 | Kastalsky | |
| 2002/0011777 | A1 * | 1/2002 | Konishi et al. | 313/495 |
| 2002/0134978 | A1 | 9/2002 | Kastalsky | |
| 2002/0163287 | A1 * | 11/2002 | Cheng et al. | 313/309 |
| 2003/0090190 | A1 | 5/2003 | Takai | |
| 2003/0146689 | A1 | 8/2003 | Hwu | |
| 2004/0058153 | A1 | 3/2004 | Ren | |
| 2004/0222734 | A1 | 11/2004 | Oh | |

OTHER PUBLICATIONS

Nano SU-8 Negative Tone Photoresist Formulations 2-25, MICROCHEM, 4 pages, Rev Feb. 2002.

K.B.K. Teo, et al., "Uniformed Patterned Growth of Carbon Nanotubes Without Surface Carbon", Applied Physics Letters, vol. 79, No. 10, pp. 1534-1536 Sep. 3, 2001.

(Continued)

*Primary Examiner* — Bumsuk Won
(74) *Attorney, Agent, or Firm* — Carl A. Giordano, Esq.

(57) ABSTRACT

A flat panel display including: a film electron emitting cathode; and, an anode including: a plurality of pixels, a plurality of TFT circuits, each being associated with a corresponding one of the circuits; and a conductive frame laterally separating the pixels and substantially isolating their respective electric fields.

22 Claims, 5 Drawing Sheets

OTHER PUBLICATIONS

C.J. Spindt et al., "9.2 Thin CRT Flat-Panel-Display Construction and Operating Characteristics" SID-98 Digest, pp. 99-102, 1998.

C.A. Spindt et al., "A Thin-Film Field-Emission Cathode" Journal of Applied Physics, vol. 39, No. 7, pp. 3504-3505, Jun. 1968.

Shoushan Fan et al., "Self-Oriented Regular Arrays of Carbon Nanotubes and Their Field Emission Properties", Science Magazine, vol. 283, pp. 512-514, Jan. 22, 1999.

J. Kim et al., "Growth and Field Emission of Carbon Nanotubes on Electroplated Ni Catalyst Coated on Glass Substrates", J.of App. Phys.,vol. 90, No. 5, pp. 2591-2594, Sep. 1, 2001.

Z.F. Ren et al., "Growth, Characterization, and Potential Applications of Periodic Carbon Nanotube Arrays", 2 pages.

Bingqing Wei et al, "Lift-Up Growth of Aligned Carbon Nanotube Patterns", Applied Physics Letters, vol. 77, No. 19, pp. 2985-2987, Nov. 6, 2000.

* cited by examiner

LOW VOLTAGE PHOSPHOR WITH FILM ELECTRON EMITTERS DISPLAY DEVICE

RELATED APPLICATIONS

This application is a continuation of U.S. application Ser. No. 11/417,631, filed May 4, 2006, now U.S. Pat. No. 7,728,506 entitled "Low Voltage Phosphor With Film Electron Emitters Display Device", which is a continuation-in-part of U.S. patent application Ser. No. 10/974,311 entitled "Hybrid Active Matrix Thin-Film Transistor Display," filed on Oct. 27, 2004, now U.S. Pat. No. 7,327,080 which is a continuation-in-part of U.S. patent application Ser. No. 10/782,580 entitled "Hybrid Active Matrix Thin-Film Transistor Display," filed on Feb. 19, 2004, now U.S. Pat. No. 7,274,136 which is a continuation-in-part of U.S. patent application Ser. No. 10/763,030 entitled "Hybrid Active Matrix Thin-Film Transistor Display," filed on Jan. 22, 2004, now abandoned which is a continuation-in-part of U.S. patent application Ser. No. 10/102,472, now U.S. Pat. No. 7,129,626 entitled "Pixel Structure For an Edge-Emitter Field-Emission Display", filed on Mar. 20, 2002, and claims priority of U.S. patent application Ser. No. 11/417,631, filed May 4, 2006 and Provisional application Ser. No. 60/698,047 entitled "Control Grid Arrangement For Display Panel," filed on Jul. 11, 2005, the entire disclosures of which are hereby incorporated by reference herein.

FIELD OF THE INVENTION

This application is related to the field of displays.

BACKGROUND OF THE INVENTION

Flat panel display (FPD) technology is one of the fastest growing technologies in the world with a potential to surpass and replace conventional Cathode Ray Tubes (CRTs) in the foreseeable future. As a result of this growth, a large variety of FPDs exist, which range from very small virtual reality eye tools to large TV-on-the-wall displays.

Various types of FPDs utilize both hot and cold cathodes that produce electrons that activate phosphor, Structures are depicted in various patents issued by Copytele, Inc. the assignee herein, including for example, U.S. Pat. Nos. 4,655,897, 4,742,345, 5,053,763, and 5,561,443, the subject matter of these patents being incorporated by reference herein in their entirety.

It would be desirable to have a display device and method of fabricating the display device, that would be operable having a small thickness film emitter which emit electrons when a low voltage is applied in combination with a TFT matrix configuration, and that would produce a more uniform, enhanced, and adjustable brightness with greater electric field isolation between pixels. The film emitters are approximately 10 to 17 micrometers (microns) in diameter and emit electrons when the applied voltage is between approximately 5 to 15 volts. One embodiment utilizes an emitter having a thickness of 12 microns and having an applied voltage of 6 volts. This device would be useful as a FPO such as a thin CRT, incorporating virtually any electron emission system, a pixel control system, and pixels with or without memory and comprised of phosphor.

SUMMARY OF THE INVENTION

A flat panel display including: a cathode or film emitters which emit electrons when a low voltage is applied; and, an anode including: a plurality of pixels, a plurality of TFT circuits, each being associated with a corresponding one of the circuits; and a conductive frame laterally separating the pixels and substantially isolating their respective electric fields.

Figure 1:
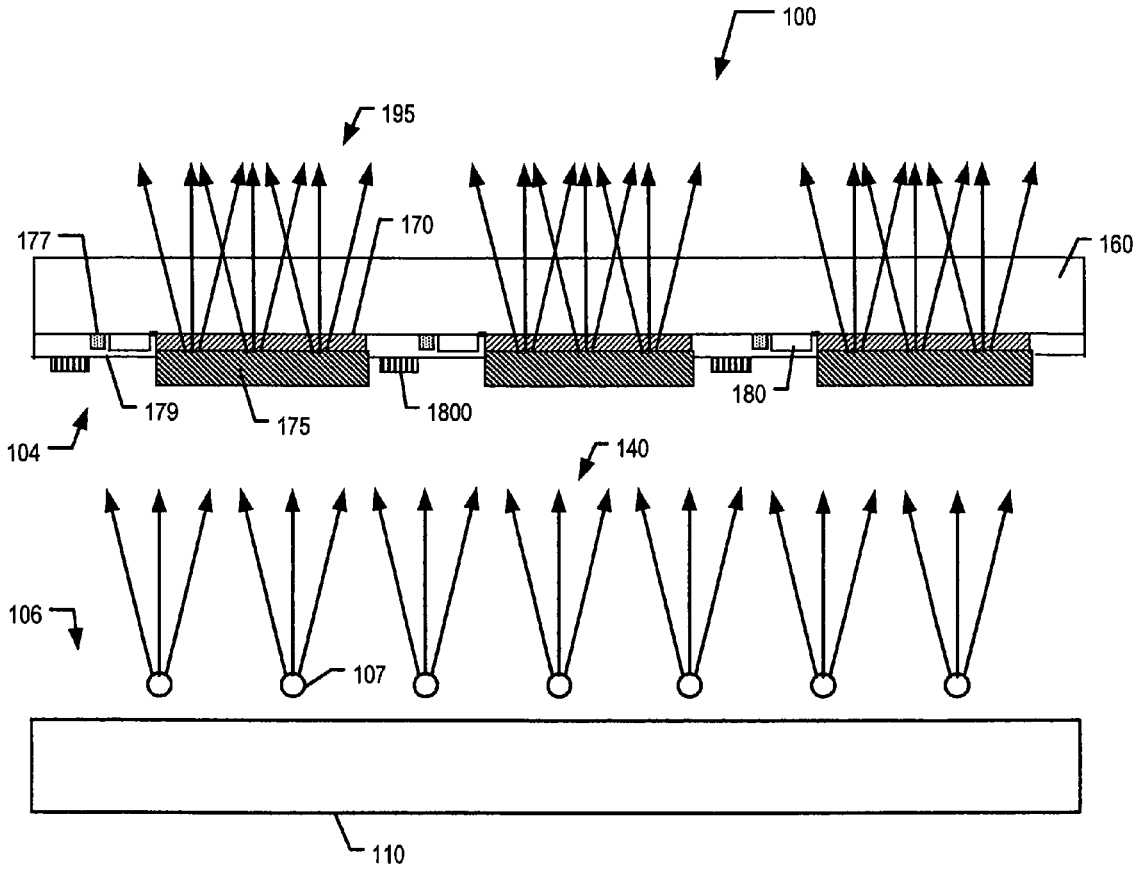
FIG. 1 illustrates a cross-sectional plan-view of a display panel incorporating a hot cathode and anode supported control frame according to an embodiment of the present invention.

It is to be understood that these drawings are solely for purposes of illustrating the concepts of the invention and are not drawn to scale. The embodiments shown herein and described in the accompanying detailed description are to be used as illustrative embodiments and should not be construed as the only manner of practicing the invention. Also, the same reference numerals, possibly supplemented with reference characters where appropriate, have been used to identify similar elements.

DETAILED DESCRIPTION OF THE INVENTION

According to an embodiment of the present invention, a display device having a cathode of film emitters which emit electrons when a low voltage is applied, TFT circuit, with a control frame disposed on the anode TFT circuit, may be provided. The control frame may be lithographically applied as a final layer surrounding the pixels, for example. In an exemplary configuration, the device operates as a thin flat Low Voltage Phosphor Display (LVPD).

The inventors have discovered that a TFT-based display device with a control frame disposed on the anode thereof exhibits enhanced performance and effects useful for display devices. Any type of electron emission source may be used with such device. According to an embodiment of the present invention, a cathode of film emitters which emit electrons when a low voltage is applied may be used. The emitters are extremely small in thickness, being between about 10 to 17 microns thick. There are "thin film" transistors (TFTs) which have thinner emitters. Such devices have thicknesses less than 5 microns and are ususually on the order of 0.01 to 1 micron thick.

Before embarking on a detailed discussion, it is noted that passive matrix displays and active matrix displays are flat panel display types that are used in various display devices, such as laptop and notebook computers, for example. In a passive matrix display, there is a matrix of solid-state elements in which each element or pixel is selected by applying a potential voltage to a corresponding row and column line that forms the matrix. In an active matrix display, each pixel is further controlled by at least one transistor and a capacitor that is also selected by applying a potential to a corresponding row and column line.

According to an embodiment of the present invention, a vacuum flat panel display using a thin-film-transistor (TFT) circuit may be provided. Associated with each pixel element is a TFT circuit that, in one configuration, includes first and second electrically cascaded active devices and a capacitor in communication with an output of the first device and an output of the second device. The circuit selectively addresses pixel elements in the display. In an exemplary embodiment, a cathode of film emitters that emit electrons when a low voltage is applied, are used to emit electrons that are drawn to selected pixel elements that include phosphor pads, which emit light of a known wavelength when struck by the emitted electrons.

FIG. 1 illustrates a schematic cross-sectional view of a TFT anode/hot cathode. The cathode is an array of film emitters which emit electrons when a low voltage is applied. The cathode and anode are incorporated in a LVPD device 100 according to an embodiment of the present invention. In this exemplary embodiment, display 100 includes a cathode of film emitters 107 that acts as a source of electrons 140 when a low voltage is applied, an anode 104 that employs TFT circuitry to control the attraction of electrons 140 to corresponding pixel element on a substrate 160, and a control frame 1800 disposed on a passivation layer 179 of the anode and surrounding each of pixels 170/175.

A second substrate 110, and side-walls (not shown) close the display 100 housing. Substrates 160, 110 may take the form of glass substrates, for example.

Anode 106 is composed of a plurality of conductive pads 170 fabricated in a matrix of substantially parallel rows and columns on substrate 160 using known fabrication methods. Column-oriented conductive lines 177 are associated with each of the corresponding conductive pads 170. In the illustrated embodiment, conductive pads 170 are composed of an electrically conductive and transparent material, such as ITO (Indium Titanium Oxide). It should be recognized though that the conductive pads may be opaque or transparent depending upon desired application and/or viewing perspective (see, e.g., FIGS. 1, 4).

Deposited on each conductive pad 170 is a low voltage phosphor layer 175. Phosphor layer 175 may be selected from materials that emit light 195 of a specific color. The low voltage phosphors emit light when activated by the voltage between 12 to 50 volts. In a conventional RGB display, phosphor layer 175 may be selected from materials that produce red light, green light or blue light 195 when struck by electrons 140. As would be appreciated by those skilled in the art, the terms "light" and "photon" are synonymous and are used interchangeably herein.

A matrix organization of conductive pads 170 and phosphor layers 175 (e.g., pixels 170/175) allows for X-Y addressing of each of the individual pixel elements in the display.

Associated with each conductive pad 170/phosphor layer 175 pixel is a TFT circuit 180 that is operable to apply a known voltage to the associated conductive pad 170/phosphor layer 175 pixel. TFT circuit 180 operates to apply either a first voltage to bias the associated pixel element to maintain it in an "off" state or a second voltage to bias an associate pixel element to maintain it in an "on" state, or an intermediate sate. In this illustrated case, each conductive pad 170 is inhibited from attracting electrons 140 emitted by cathode 107 when in an "off" state, and attracts electrons 140 when in an "on" state or any intermediate state.

Using TFT circuitry 180 to bias conductive pads 170 provides for both addressing pixel elements and maintaining the pixel element in a condition to attract electrons for a desired time period, i.e., time-frame or one or more sub-periods of a time-frame. Co-pending patent application Ser. No. 10/782,580 entitled "Hybrid Active Matrix Thin-Film Transistor Display" filed on Feb. 19, 2004 and assigned to Copytele, Inc. the assignee, describes various TFT, anode, and cathode configurations useful in implementing the present invention, the subject matter thereof incorporated by reference herein in its entirety.

TFT circuits 180 and conductive lines 177 may be formed on substrate 160 using lithographic techniques, for example. TFT circuits 180 and conductive lines 177 may then be passivated by passivating layer 179. Passivating layer 179 may be deposited over substrate 160, circuits 180 and conductive lines 177, for example. Control frame 1800 may then be formed over passivating layer 179.

Figure 2:
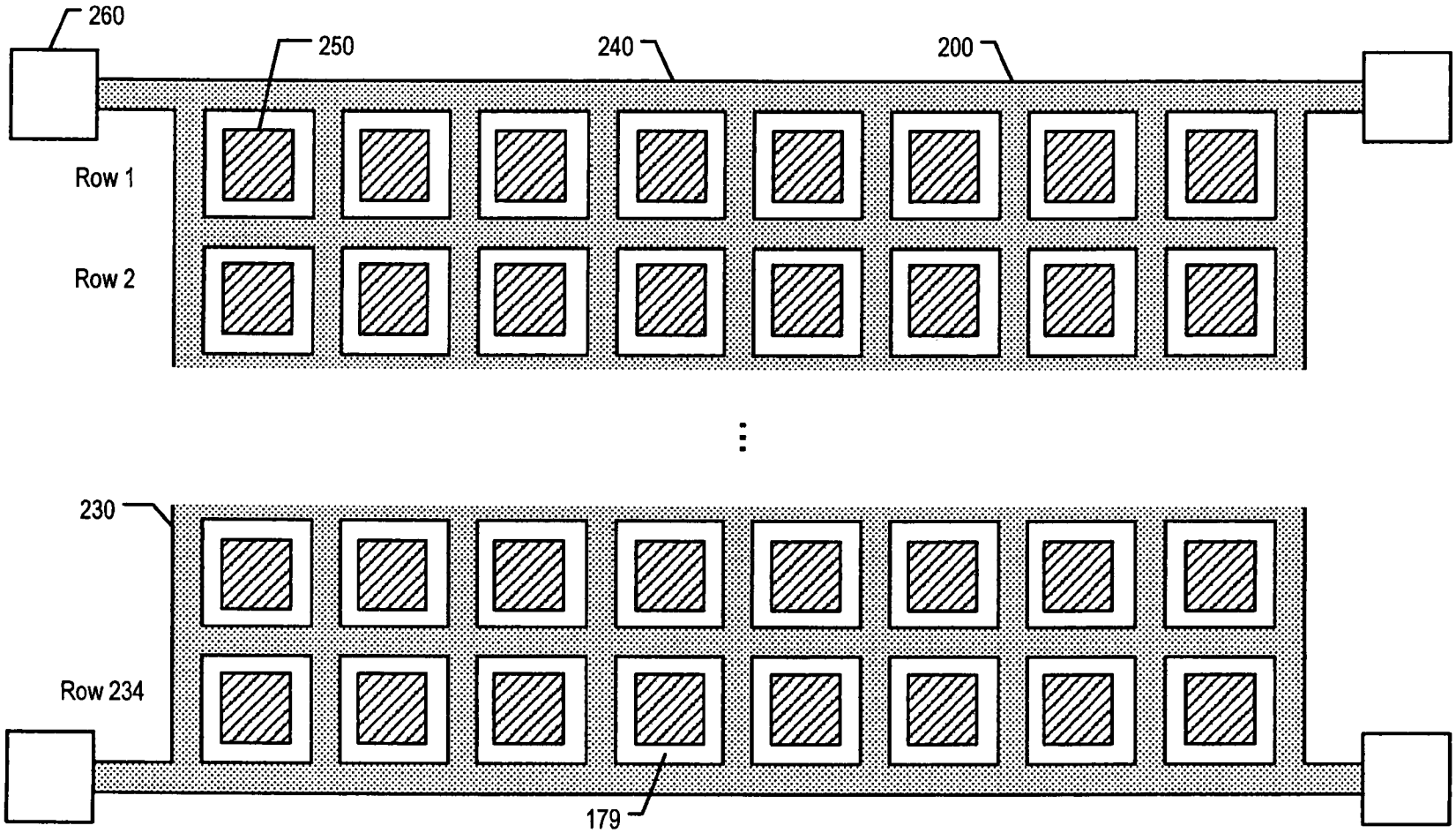
FIG. 2 illustrates a plan-view of the anode with the control frame of FIG. 1.

Referring now to FIG. 2 in conjunction with FIG. 1, there is illustrated a conductive control frame 200. Control frame 200 is suitable for use as control frame 1800 according to an embodiment of the present invention. Control frame 200 helps produce a uniform and adjustable brightness and a bright image by providing good electric field uniformity within display 100. Further, where control frame 200 is essentially in the same plane as the pixels (see, 1800 FIG. 1), it does not obscure the produced image.

Control frame 200 comprises a plurality of conductors arranged in a rectangular matrix having substantially parallel vertical lines 230 and substantially parallel horizontal lines 240, respectively. Each pixel 250 is generally bounded by the intersection of vertical conductor lines 230 and horizontal conductor lines 240, such that the control frame conductors 230, 240 surround each of corresponding pixels 250 to the right, left, top, and bottom. One or more conductive pads 260 connect to the conductors 230, 240 to electrically power frame 200. In one embodiment, four conducting pads connect to the metal lines, with each pad being about 100×200 micrometers (microns) in size. The control frame 200 may be provided as a metal layer above the TFT passivation layer 179 (see FIG. 1). The pads 260 and metal lines which comprise the control frame structure 200 should remain free from passivation. In an exemplary configuration, the control frame metal layer has a thickness of less than about 1 micon, although it is understood that other thicknesses may be used depending on the particular application.

An appropriate voltage applied to the control frame prevents appearance of mutual field effects between neighboring pixels 250, and thus enables a more uniform and greater brightness of each individual pixel. Typically, the voltage applied to the frame is between 5 to 15 volts. Prior art configurations are susceptible to the effects of undesirable electric fields between pixels, particularly when control voltages are operated to activate one pixel ("high") while a neighboring pixel is inactive ("low"). The control frame of the present invention operates as a shield to suppress such undesirable electric fields between pixel structures and better isolate and stabilize each of the pixels. Note that in alternate configurations the control frame may include only metal lines parallel to the columns or only metal lines parallel to the rows. The conductors 230, 240 may be connected in a number of configurations. For example, in one configuration, all horizontal and vertical conductors are joined together shown in FIG. 2 and a voltage is applied to the entire control frame configuration.

In another configuration, all horizontal conductors 240 are joined and separately all vertical conductors 230 are joined.

In this connection configuration the horizontal conductors and the vertical conductors are not electrically connected. A voltage is applied to the horizontal conductor array, and a separate voltage is applied to the vertical conductor array.

Other configurations are also contemplated, including for example, a configuration powering horizontal conductors only, or a configuration powering vertical conductors only. In these configurations, the device shields the pixels from undesirable electric fields in only one direction.

In an embodiment of the present invention, the vertical line conductors 230 and horizontal line conductors 240 are framing each pixel 250 and are above the plane of the pixels 250. However, it is understood that other configurations are contemplated where the conductors are disposed in the same plane as the pixels.

A control frame voltage of up to about one half the corresponding anode voltage may be applied to produce good brightness and uniformity conditions. However, the voltages may be varied to optimize other aspects and features of the TFT based display, such as contrast, gray scale, and color combinations, for example.

While a control frame voltage of about one half the corresponding anode voltage may generally produce optimum brightness and uniformity conditions, the anode voltage of each pixel determines the brightness or color intensity of each pixel. In order to control gray scale and/or color combinations, the control frame voltage of each pixel may be changed depending on an applied characteristic, such as the data amplitude applied to that pixel.

Figure 3:
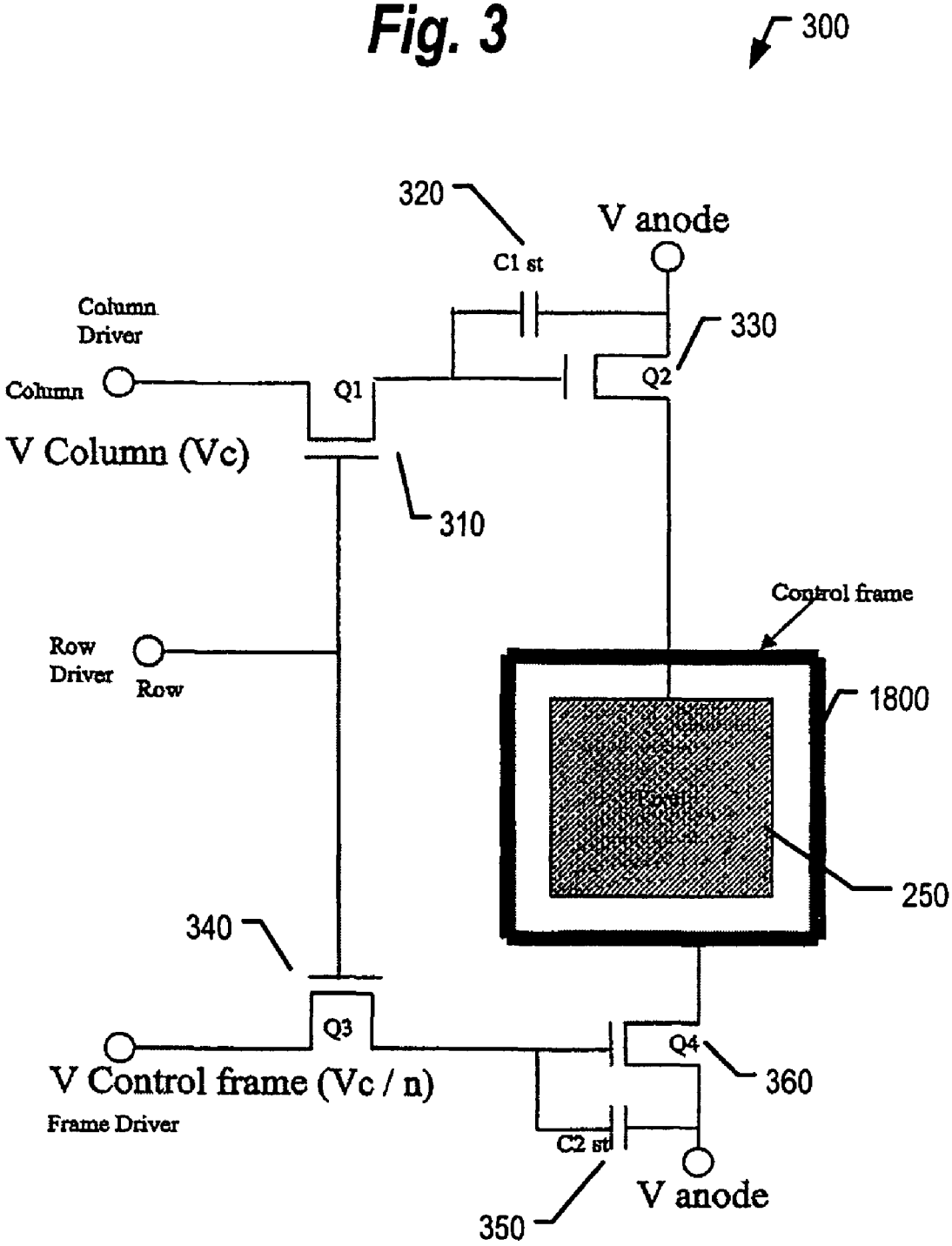
FIG. 3 illustrates a schematic view of a circuit suitable for use with the anode of FIGS. 1 and 2 according to an embodiment of the present invention.

According to an aspect of the present invention, control of one or more of the TFTs associated with the display device of the present invention may be accomplished using the circuit 300 of FIG. 3. Circuit 300 includes first and second transistors 310, 330 and capacitor 320 electrically interconnected with a pixel, e.g., pad 340, FIG. 1.

According to an aspect of the present invention, a second TFT (see FIG. 3 may be used to generate a control frame voltage which is equal to the column voltage (Vc) divided by a ratio factor (n). The second circuit also includes first and second transistors 340, 360 and a capacitor 350. The factor (n) may be selected to produce the optimum results for a particular application. In an exemplary operation, data may be provided via the column driver (Vc) to produce an amplitude signal. If a predetermined amount (e.g. half) of the voltage of that signal is to be applied to the frame at the same time, then (n) equals 2. The control frame driver (Vc/n) thus applies to the control frame one half of the voltage as is applied at the corresponding particular pixel. The structure is driven using the same row driver (row) such that when a given row N (e.g. row 1-234, FIG. 1) is turned on, the corresponding pixel N (e.g. pixel 1 of row) receives a voltage from the column driver, and the control frame around pixel 1 receives a voltage from the control frame driver which is a fraction of the voltage across pixel 1. When pixel 2 is turned on, the corresponding control frame surrounding that pixel (i.e. the control frame surrounding pixel 2) receives a control frame voltage that is a fraction of the column driver voltage appearing at pixel 2. Thus, for each column N (e.g. where n equals 960 columns), there exists a corresponding n equal to 960 frames, where each frame receives a control voltage each time the corresponding pixel associated with that control frame receives an applied column driver voltage. Storage, capacitors 320 and 350 operate to hold the charge on each of the pixel and the control frame for an entire frame. When processing proceeds to the next row (e.g. row 2), the row 1 pixels are still drawing current. In this manner, capacitor 350 "remembers" the frame voltage when proceeding from one row to the next (e.g. from the first row to the second row) while capacitor 330 "remembers" the pixel voltage when going to the next row. Such processing operations continue through the entire frame.

Control of one or more of the TFTs associated with the display device of the present invention may be accomplished in the following manner. In general, the voltage (Row) used to select the row is equal to the fully "on" voltage (Vc) of the column. The voltage Row in this case causes the pass transistor 310 to conduct. The resistance of transistor 310, the capacitor 320 and the write time of each selected row determines the voltage at the gate of transistor 330 as compared to Vc. Using a voltage Row higher than the fully "on" voltage (Vc) increases the conduction of transistor 310, reducing its resistance and resulting in an increase in pixel voltage and enhanced brightness. The same advantage will also apply to the control frame voltage applied to transistors 340, 360. Thus, the selection voltage for the row is higher than the highest column voltage, thereby causing the transistors 310, 330 to conduct with a reduced resistance, thereby providing a greater voltage on the gates of transistors 340, 350.

It is further understood that other circuit configurations may also be utilized. For example, the voltage applied to the control frame structure around each pixel may also be generated by using a voltage divider circuit at each pixel which produces a voltage which is proportional to the pixel voltage.

As is shown in FIG. 1, control frame 1800, and associated horizontal and vertical lines illustrated in FIG. 2, may be utilized with a cathode film emitter as a source of electrons when current is passed through. The control frame may be formed in the following manner. Using a mask the control frame may be formed using the conventional method of imaging the desired structure on a photoresist layer which is placed on a metal layer, above the passivation layer, and then etching. A lift-off technique may also be employed.

Figure 4:
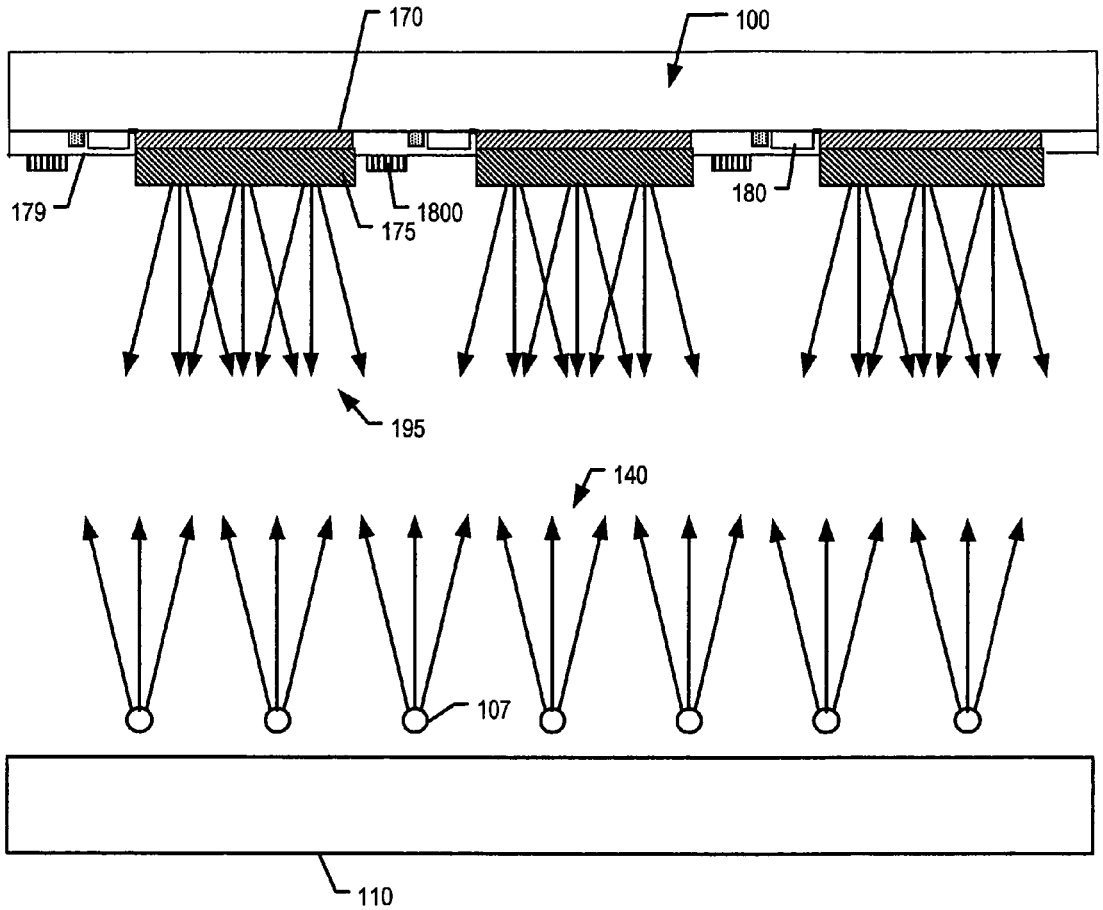
FIG. 4 illustrates a cross-sectional plan-view of a display panel incorporating a hot cathode and anode supported control frame according to an embodiment of the present invention.

Referring now also to FIG. 4, there is shown a display according to another embodiment of the present invention. Like elements of the displays of FIGS. 2 and 4 have been labeled with like references. In such a case, substrate 160 need not be transparent as the viewing perspective is through substrate 110, as opposed to substrate 160 (see, e.g., FIG. 1).

Figure 5:
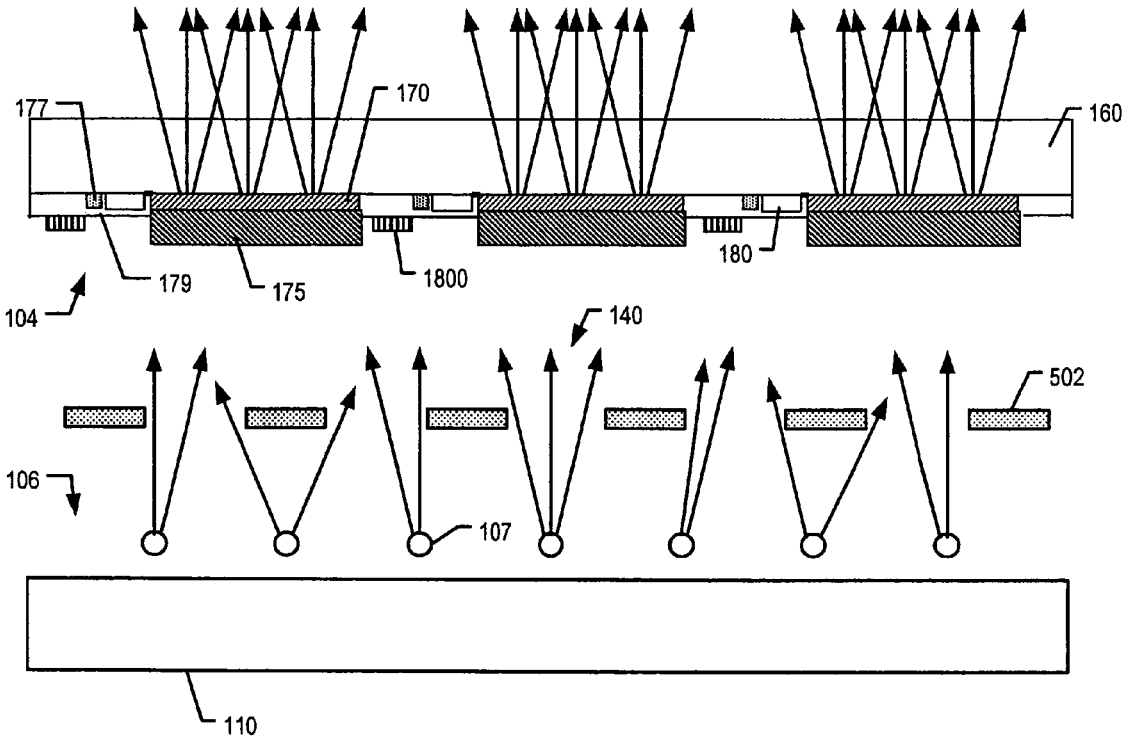
FIG. 5 illustrates a cross-sectional plan-view of a display panel incorporating a cathode of film emitters which emit electrons when a low voltage is applied an anode supported control frame and a control grid according to an embodiment of the present invention.

Referring now also to FIG. 5, there is shown a display according to another embodiment of the present invention. Again, like elements of the displays of FIGS. 2 and 5 have been labeled with like references. The display of FIG. 5 additional includes a grid 502. Grid 502 may be composed of steel or a conductive metal or alloy having a low temperature coefficient of expansion, for example. Grid 502 may serve to further equalize the electric field between anode 106 and cathode 104, resulting in improved display uniformity.

While there has been shown, described, and pointed out fundamental novel features of the present invention as applied to preferred embodiments thereof, it will be understood that various omissions and substitutions and changes in the apparatus described, in the form and details of the devices disclosed, and in their operation, may be made by those skilled in the art without departing from the spirit of the present invention. For example, the control frame described previously may be used with any display which uses electrons or charged particles to form an image, such as, a LVPD, Field Emission Display, Electrophoretic.

It is expressly intended that all combinations of those elements that perform substantially the same function in substantially the same way to achieve the same results are within the scope of the invention. Substitutions of elements from one described embodiment to another are also fully intended and contemplated.

What is claimed is:

1. A flat panel display comprising:
a cathode of film emitters that emit electrons when a low voltage is applied; and
an anode comprising:
a plurality of pixels,
a plurality of TFT circuits, each being associated with a corresponding one of the plurality of pixels; and
a voltage source being associated with a control frame laterally separating the pixels and substantially isolating their respective electric fields, wherein the plurality of TFT circuits providing a first voltage to said corresponding one of the plurality of pixels and the voltage source providing a second voltage, concurrently, to said control frame surrounding the corresponding one of the plurality of pixels, wherein the second voltage is no greater than one-half that of the first voltage.

2. The display of claim 1, further comprising a conductive grid interposed between the cathode and the anode.

3. The display of claim 1, further comprising a first substrate, wherein the pixels, TFT circuits and control frame are formed on the first substrate.

4. The display of claim 3, further comprising a plurality of column conductors electrically coupled to the pixels.

5. The display of claim 4, further comprising a passivating layer over the pixels, TFT circuits and column conductors.

6. The display of claim 5, wherein the control frame is on the passivating layer.

7. The display of claim 6, wherein the control frame comprise a first plurality of substantially parallel conductors.

8. The display of claim 7, wherein the control frame comprises a second plurality of substantially parallel conductors and the first plurality of conductors is substantially perpendicular to the second plurality of conductors.

9. The display of claim 1, wherein the control frame is in the same plane as the pixels.

10. The display of claim 1, wherein the film emitters are between 10 to 17 microns in thickness.

11. The display of claim 1, wherein the control frame comprises a plurality of conductors arranged in a matrix having vertical conductors and horizontal conductors, respectively.

12. The display of claim 11, wherein the control frame bounds each pixel by the intersection of a vertical conductor and a horizontal conductor.

13. The display of claim 11, wherein the horizontal conductors and vertical conductors are separate electric circuits.

14. The display of claim 13, wherein a first of the second-voltage is applied to one or more horizontal conductors, and a second of the second voltage is applied to one or more vertical conductors.

15. The display of claim 11, wherein the horizontal and vertical conductors are electrically interconnected.

16. The display of claim 1, wherein the control frame is a metal layer above a TFT passivation layer.

17. The display of claim 1, wherein the second voltage operates to activate the corresponding control frame.

18. The display of claim 1, wherein the voltage source comprises a second set of TFT circuits.

19. The display of claim 1, wherein the voltage source comprises a source suitable to apply a voltage between 5 and 15 volts.

20. A flat panel display comprising:
a cathode of film emitters that emit electrons;
an anode comprising:
a plurality of pixels, each including at least one phosphor capable of emitting light; and
a control frame surrounding each of the plurality of pixels; and
means for applying a pixel voltage to selected ones of said pixels, said pixel voltage being associated with a data amplitude applied to the selected ones of said pixels; and
means for applying a control voltage, concurrently, to sections of the control frame corresponding to the selected ones of said pixels, wherein the control frame voltage is equal to pixel voltage/n, where "n" is no less than 2.

21. The display of claim 20, wherein the means for applying a control voltage comprises a second set of TFT circuits.

22. The display of claim 20, wherein the means for applying a control voltage comprises a source suitable to apply a voltage between 5 and 15 volts

* * * * *